United States Patent [19]

Spademan

[11] 4,360,218

[45] Nov. 23, 1982

[54] STEP-IN ELECTRICAL RELEASABLE SKI BINDING

[76] Inventor: Richard G. Spademan, Box 6410, Incline Village, Nev. 89450

[21] Appl. No.: 155,302

[22] Filed: Jun. 2, 1980

[51] Int. Cl.[3] ..... A63C 9/08

[52] U.S. Cl. ..... 280/624; 280/611; 280/612; 280/623

[58] Field of Search ..... 280/612, 611, 623, 624, 280/625, 626

[56] References Cited

U.S. PATENT DOCUMENTS

| | | | |
|---|---|---|---|
| 3,246,907 | 4/1966 | Chisholm | 280/612 |
| 3,819,189 | 6/1974 | Smolka et al. | 280/612 |
| 4,063,752 | 12/1977 | Whitaker et al. | 280/624 |
| 4,140,331 | 2/1979 | Salomon | 280/612 |

*Primary Examiner*—Joseph F. Peters, Jr.
*Assistant Examiner*—Milton L. Smith
*Attorney, Agent, or Firm*—Townsend and Townsend

[57] ABSTRACT

In a step-in electrical releasable ski binding (1) there is provided clamping means (5,6) having an open condition and a closed condition and a force unit (15) for providing a clamping force for releasably securing a ski boot (4) to a ski (2). A holding means (32) is provided for holding the clamping means (5,6) in its open condition against the force of the force unit (15). An electrically operated solenoid assembly (40) is provided which is responsive to the placing of the ski boot (4) in skiing position in the binding for releasing the clamping means (5,6) from the holding means (32) for closing the clamping means (5,6) with the force of the force unit (15).

23 Claims, 9 Drawing Figures

DECOUPLER
DECOUPLER
TO 11
TO 10
1
3
6
7
10
11
15
16
17
18
19
20
21
22
23
25
30
31
32
40
41
42
43
44
44A
45
46
52

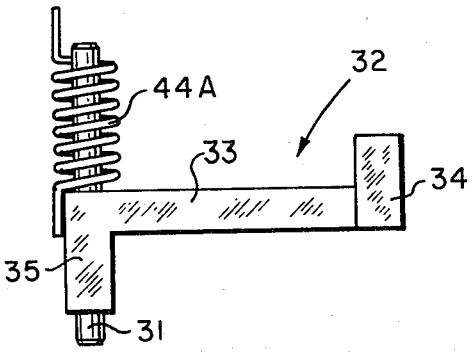
FIG. 4
FIG. 5
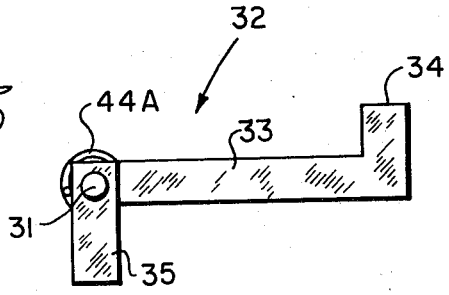
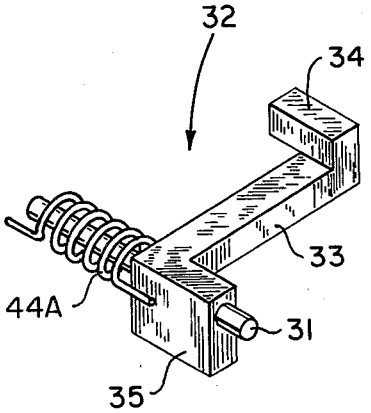
FIG. 6

FIG. 7
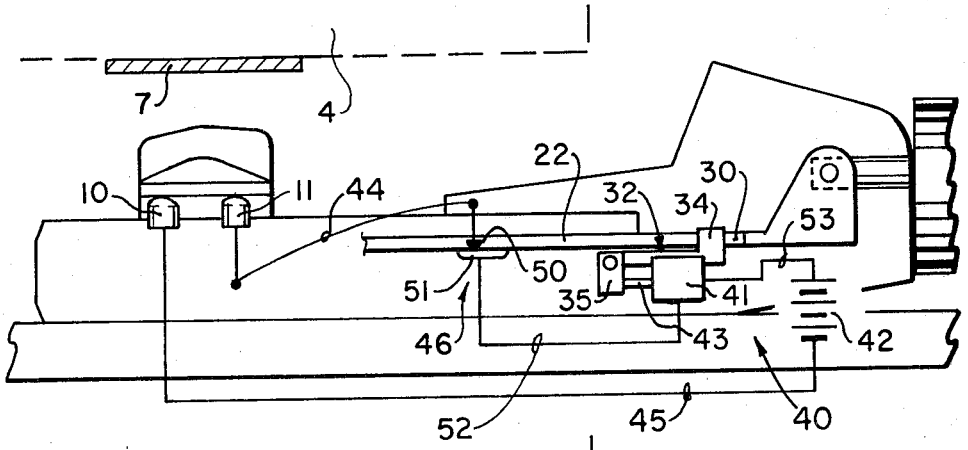
FIG. 8
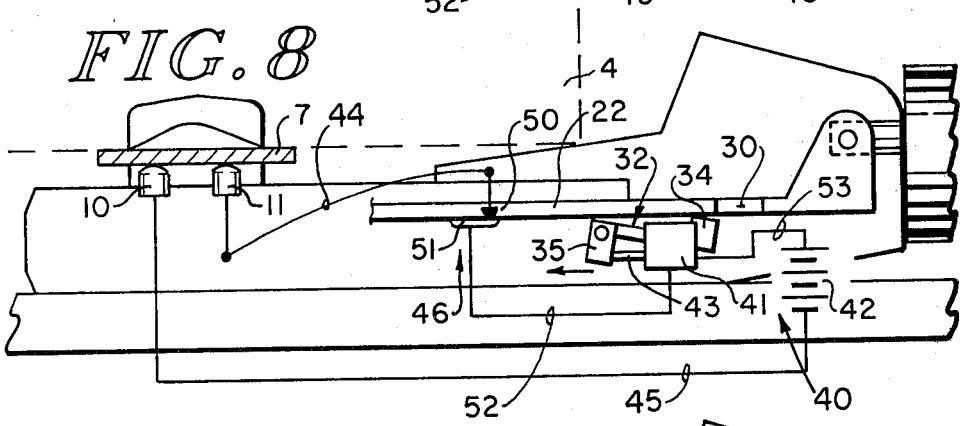
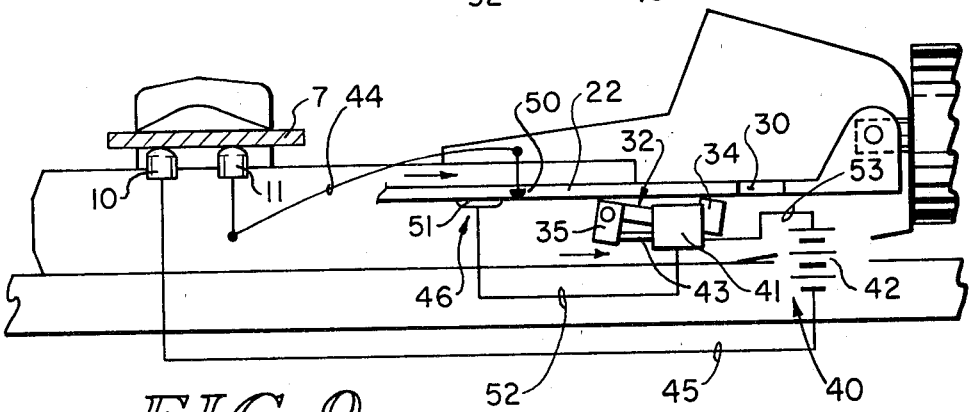
FIG. 9

STEP-IN ELECTRICAL RELEASABLE SKI BINDING

BACKGROUND OF THE INVENTION

The present invention relates to ski bindings in general and in particular to step-in releasable ski bindings of a type disclosed in U.S. Pat. No. 4,063,752 issued Dec. 20, 1977 to Whitaker et al. In U.S. Pat. No. 4,063,752 there is disclosed a step-in releasable ski binding comprising a pair of side-clamping members. The side-clamping members are provided for releasably securing a ski boot to a ski rearward of the toe and forward of the rear of the heel of the ski boot. Located between the side clamping members there is provided a movable trigger member. Located at the rear of the binding there is provided a force unit comprising an overcenter spring assembly movable between a horizontal and a vertical position. A connecting member is provided for connecting the spring assembly of the force unit to the clamping members.

In operation, when the overcenter spring assembly is raised from its horizontal position toward its vertical position, the clamping force of the spring assembly is removed from the clamping members. With the clamping force removed from the clamping members, the clamping members are permitted to be extended outwardly. As the clamping members are extended outwardly, a spring on the trigger member moves the trigger member to a position to be contacted by a ski boot entering the binding causing the trigger member to engage the connecting member. When the spring assembly is returned to its horizontal position for applying a clamping force to the clamping members through the connecting member, the clamping members are held in their open position against the clamping force by the trigger member.

When a skier steps into the binding and presses down on the trigger member, the trigger member disengages from the connecting member. As the trigger member disengages from the connecting member, the clamping force of the overcenter spring assembly closes the clamping members for securing the ski boot to the ski.

The binding disclosed in U.S. Pat. No. 4,063,752 and briefly described above, is entirely mechanical and requires a movable mechanical trigger member and a downward force for its operation.

SUMMARY OF THE INVENTION

In contrast to the purely mechanical step-in releasable ski binding disclosed and described in U.S. Pat. No. 4,063,752, a principal object of the present invention is a step-in electrical releasable ski binding for releasably securing a ski boot to a ski. In accordance with this object, there is provided a securing means having an open condition and closed condition for releasably securing a ski boot to a ski, a force unit for providing a securing force, means for applying the securing force to the securing means, a holding means for holding the securing means in its open condition against the force of the force unit and a solenoid assembly responsive to the placing of a ski boot in the binding in skiing position relative to the securing means for releasing the securing means from the holding means. When the securing means is released from the holding means, the securing force changes the securing means to its closed condition. In the embodiment disclosed, the activation of the electrical apparatus is in response to the closing of a pair of electrical contacts by the placing of a conductor across the contacts. In an alternative embodiment, a movable switch member is used for closing the contacts.

BRIEF DESCRIPTION OF THE DRAWING

The above and other objects, features and advantages of the present invention will become apparent from the following detailed description of the accompanying drawing in which:

FIG. 4 is a plan view of a holding member according to the present invention.

FIG. 5 is a side elevation view of FIG. 4.

FIG. 6 is a perspective view of the holding member of FIGS. 4 and 5.

FIG. 7 is a diagrammatic representation of the binding and electrical apparatus of FIGS. 1–3 holding the binding in an open condition immediately prior to release.

FIG. 8 shows the condition of the binding and electrical apparatus of FIGS. 1–3 shortly after release.

FIG. 9 shows the condition of the binding and electrical apparatus of FIGS. 1–3 following closing of the clamping members.

DETAILED DESCRIPTION OF THE DRAWING

Figure 1:
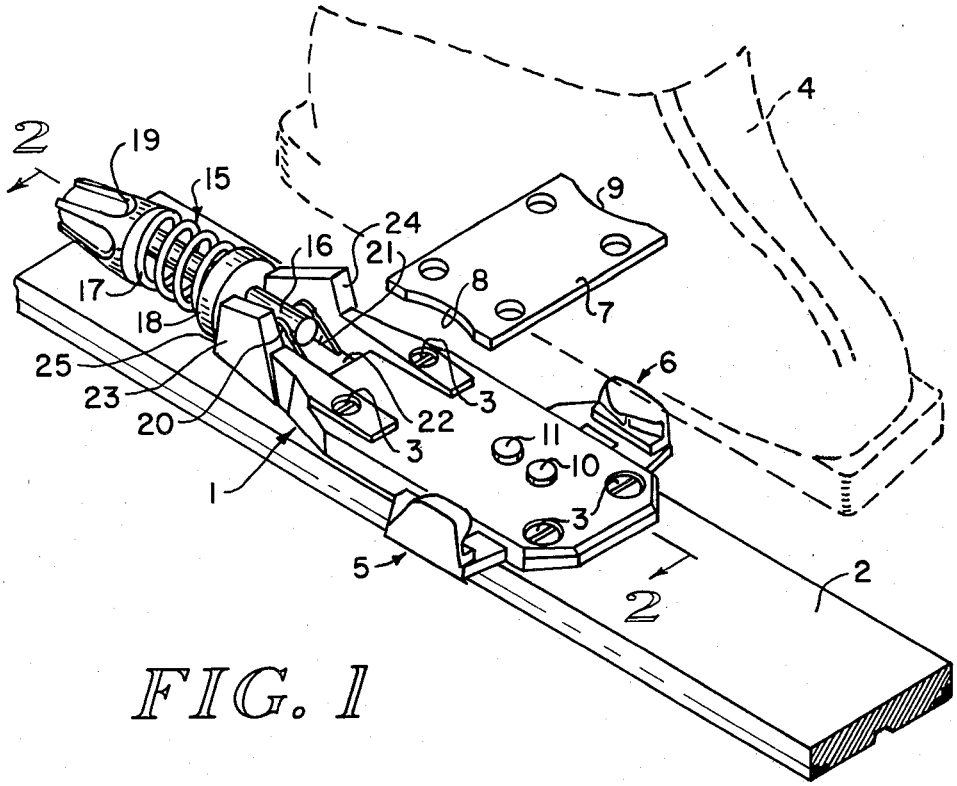
FIG. 1 is a perspective view of an embodiment of the present invention.
Figures 2, 3:
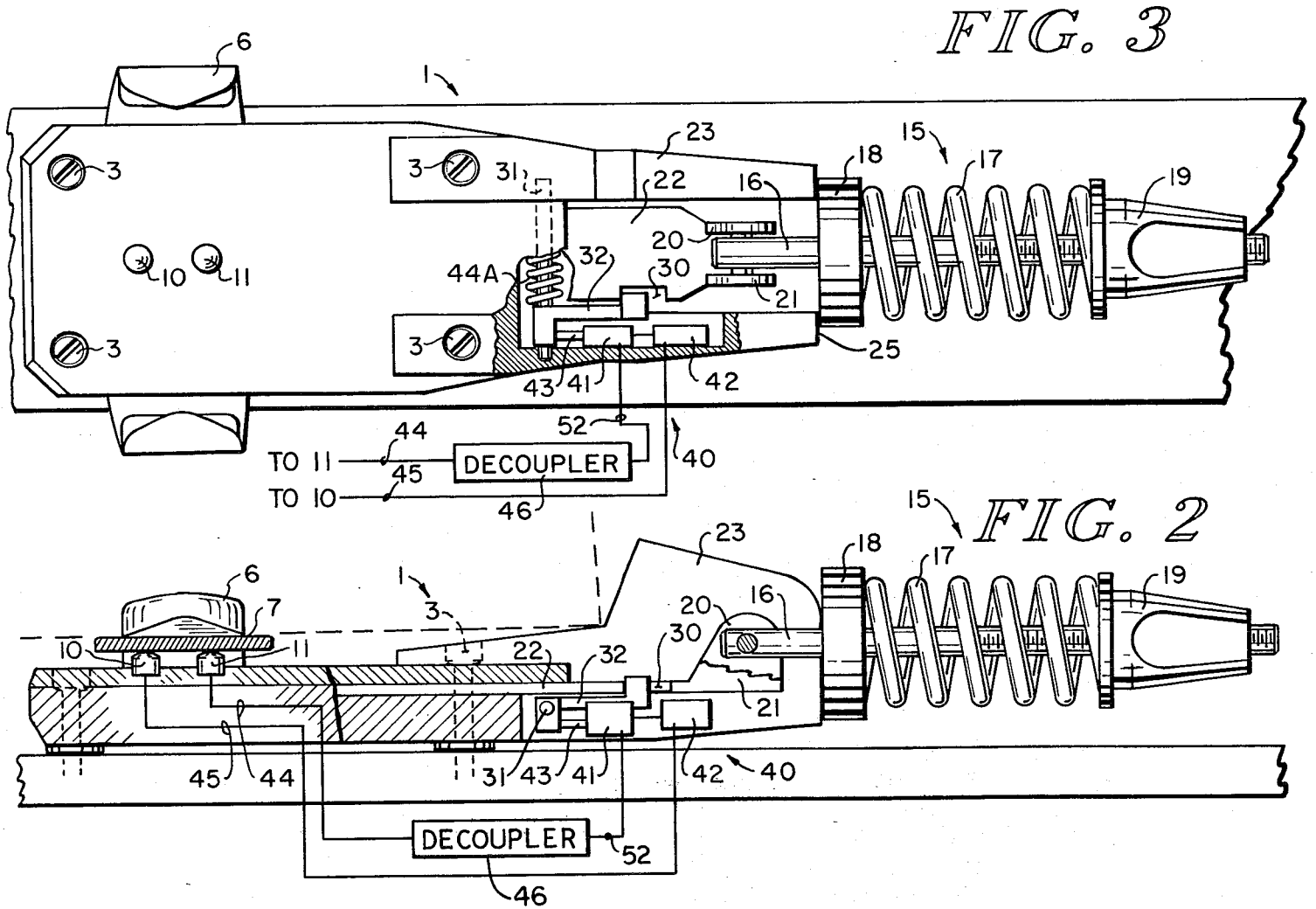
FIG. 2 is a partial cross-sectional view taken along the lines 2—2 of FIG. 1.
FIG. 3 is a partial cross-sectional plan view of the binding of FIG. 2.

Referring to FIGS. 1–3, there is provided in accordance with the present invention a step-in electrical releasable ski binding designated generally as 1. The binding 1 is mounted on a ski 2 by means of a plurality of screw members 3 for releasably securing a ski boot 4 to the ski 2. At the forward end of the binding 1, there is provided a securing means for securing the ski boot 4 to the ski 2 in the form of a pair of movable jaw members 5 and 6. The jaw members 5 and 6 are provided for releasably engaging an electrically conductive plate member 7 mounted to the sole of the ski boot 4. On its lateral edges, the plate member 7 is provided with a pair of curved surfaces 8 and 9 for engaging the jaw members 5 and 6.

Located between the jaw members 5 and 6, there is provided a pair of electrical contact members 10 and 11. The contact members 10 and 11 will be further described below with respect to FIGS. 2–9.

At its rear end, the ski binding 1 is provided with a force unit comprising an overcenter spring assembly designated generally as 15. In the assembly 15 there is provided a spring adjusting rod 16. The rod 16 extends along the longitudinal axis of the assembly 15. Coaxial with the rod 16, there is provided a spring member 17. At the forward end of the spring member 17, there is provided a spring washer 18. At the rear end of the spring member 17, there is provided an adjusting knob 19 which is threadably screwed onto the rod 16 for adjusting the compression of the spring 17.

At its forward end, the rod 16 is pivotably coupled between and to a pair of upstanding members 20 and 21 located at the rear end of a connecting member 22. The connecting member 22 is provided for coupling the force unit 15 to the clamping members 5 and 6.

Forward of the washer member 18 and on opposite sides of the connecting member 22 and rod 16, the binding 1 is provided with a pair of upstanding wall members 23 and 24 having rear edges 25 against which the washer 18 slides.

Referring to FIGS. 2–6, there is provided in an edge of the connecting member 22 forward of the upstanding members 20 and 21 a slot 30. Movably mounted alongside the connecting member 22 by means of a pin 31, there is provided for engaging the slot 30 a holding member designated generally as 32.

As seen in FIGS. 4–6, the member 32 is Z-shaped as seen in an elevation view and a top plan view. In the embodiment shown, the member 32 is provided with an elongated body member 33. At the rear end of the body member 33 there is provided a member 34 which extends inwardly therefrom for engaging the slot 30 in the connecting member 22. At the opposite end of the body member 33 there is provided a member 35 which extends in an opposite direction from the body member 33. The pin member 31 runs through the body members 35 and 33 for movably attaching the holding member 32 to the binding 1. A spring 44A is coupled to the member 32 and mounted concentric with the pin 31 for moving the member 34 into the slot 30 during the setting of the binding as will be described below.

Referring again to FIGS. 2–3, there is provided for movable contact with the member 35 of the holding member 32 a solenoid assembly designated generally as 40. In the solenoid assembly 40 there is provided a solenoid 41 and a source of power, such as a battery 42. Extending forwardly from the solenoid 41 there is provided a piston 43. As will be seen, the spring 44A on the pin 31 of the holding member 32 moves the member 34 of the holding member 32 into the slot 30 when the piston 43 of the solenoid 41 is retracted from the member 35.

Referring to FIGS. 7–9, coupling the electrical contacts 10 and 11 to the solenoid assembly 40, there is provided a pair of wires 44 and 45 and a decoupling mechanism designated generally as 46. The decoupling mechanism 46 is provided for decoupling the power supply 42 from the solenoid 41 after the binding is closed.

In the decoupling mechanism 46 there is provided a pair of contacts 50 and 51. The contact 50 is mounted to the connecting member 22 and is connected to the electrical contact 11 by means of the electrical conductor 44. The contact 51 is mounted for slidable contact with the member 50 and is connected to the solenoid 41 by means of an electrical conductor 52. One side of the battery 42 is connected to the electrical contact 10 by means of the electrical conductor 45. The opposite side of the battery 42 is connected to the solenoid 41 by means of an electrical conductor 53.

In operation, to set or reset the binding for closure, the overcenter assembly 15 is first raised toward a vertical position releasing the spring tension on the connecting member 22 allowing the connecting member 22 to move forwardly and the jaws 5 and 6 to move outwardly to their open position. As the connecting member 22 moves forwardly, the spring 44A on the holding member 32 causes the holding member 32 to rotate. As the holding member 32 is rotated, the member 34 on the rear end of the holding member 32 engages the slot 30 in the connecting member 22. After the member 34 engages the slot 30, the overcenter assembly 15 is returned to its horizontal position as shown in FIGS. 1, 2 and 3. As the overcenter assembly 15 is returned to its horizontal position the member 34 engaging the slot 30 prevents movement of the connecting member 22 rearwardly and holds the clamping members 5 and 6 in their open condition against the force of the spring member 17.

As shown in FIG. 7, except for the open contacts 10 and 11, when the binding is set for closure, there is a completed electrical circuit through the contacts 50 and 51 to the solenoid 41 and battery 42. As the ski boot 4 is inserted in the binding in skiing position relative to the securing means (jaws 5 and 6), the plate 7, which is electrically conductive, contacts the electrical contacts 10 and 11. The contacting of the plate 7 and electrical contacts 10 and 11, electrically couples the contacts 10 and 11 connecting the power supply 42 to the solenoid 41 through the decoupling mechanism 46. With the power supply 42 connected to the solenoid 41, the solenoid 41 is energized causing the piston 43 to move forwardly in the direction of the arrow shown in FIG. 8. As the piston 43 moves forwardly, it contacts the member 35 of the holding member 32 causing the holding member 32 to pivot, disengaging the member 34 from the slot 30 in the connecting member 22.

When the member 34 of the holding member 32 is disengaged from the slot 30, the connecting member 22 is moved rearwardly under the force of the spring 17. As the connecting member 22 is moved rearwardly, the clamping members 5 and 6 are drawn together as described above in U.S. Pat. No. 4,063,752. Also, as the connecting member 22 is moved rearwardly, contact 51 is decoupled from contact 50 as shown in FIG. 9. The decoupling of the contacts 50 and 51 decouples the battery 42 from the solenoid 41. The decoupling of the battery 42 from the solenoid 41 prevents premature discharging of the battery during normal skiing when the plate 7 is coupling the contacts 10 and 11.

With the battery 42 decoupled from the solenoid 41, the piston 43 is free to retract when the holding member 32 is rotated to its initial position as shown in FIG. 7 by the spring 44A. The holding member 32 will be rotated by the spring 44A to its initial position as shown in FIG. 7 during the resetting of the binding when the overcenter spring assembly 15 is rotated vertically, the clamping members 5 and 6 are opened and the connecting member 22 moves forwardly as described above.

While an embodiment of the present invention is disclosed, it is contemplated that numerous changes in the arrangement of the parts described and their composition may be made without departing from the spirit and scope of the present invention. For example, it is contemplated that, while electrical conductors in the form of wires are shown for connecting the electrical contacts 10 and 11 to the solenoid assembly 40, it is understood that portions of the binding 1 itself may be used in place of one of the electrical conductors. Instead of using the decoupling mechanism 46 comprising the separable contacts 50 and 51, the decoupling mechanism 46 for decoupling the power supply 42 from the solenoid 41 may comprise a conventional type of timing mechanism activated by a current flowing in the circuit for a predetermined time. While described with respect to a releasable ski binding for releasably securing a ski boot to a ski rearward of the toe and forward of the rear of the heel of the ski boot, it is also contemplated that features of the present invention may be applicable to other types of releasable ski bindings including other types of toe-heel, electrical and magnetic ski bindings.

Also movable switch members may be used for coupling power to the solenoid. Accordingly, it is intended that the embodiments described and the modifications suggested thereby, should be used only for purposes of describing the present invention and that the scope of the present invention be determined solely by reference to the claims hereinafter provided and their equivalents.

What is claimed is:

1. An electrical releasable step-in ski binding comprising:

means changeable from a non-securing condition to a securing condition for releasably securing a ski boot to a ski; and electrical means responsive to a placing of said ski boot in skiing position relative to said securing means for changing said securing means from said non-securing condition to said securing condition, the electrical means including first and second electrical contacts, means for electrically coupling the contacts in response to placing the ski boot in skiing position relative to the securing means, and means responsive to the coupling of the contacts for coupling a source of electrical power to the electrical means and having means for decoupling the source of power from the electrical means after the securing means is changed from the non-securing condition to the securing condition.

2. A ski binding according to claim 1 wherein said coupling means comprises means located on said ski boot for electrically coupling said contacts.

3. A ski binding according to claim 2 wherein said coupling means located on said ski boot comprises an electrically conductive member.

4. A ski binding according to claim 1 wherein said securing means comprises:

means movable from a non-securing condition to a securing condition for releasably securing a ski boot to a ski;

a force unit for applying a securing force to said securing means;

means for holding said securing means in said non-securing condition against said securing force; and wherein said changing means comprises means responsive to said placing of said ski boot in skiing position relative to said securing means for releasing said securing means from said holding means.

5. A ski binding according to claim 4 wherein said holding means comprises a movable member having an interfering position for preventing movement of said securing means and a non-interfering position for allowing movement of said securing means, and wherein said releasing means comprises means for moving said movable member from said interfering position to said non-interfering position.

6. A ski binding according to claim 5 wherein said moving means comprises a solenoid assembly operable in response to said placing of said ski boot in skiing position relative to said securing means for moving said movable member from said interfering position to said non-interfering position.

7. A ski binding according to claim 5 wherein said securing means comprises means for moving said securing means from said securing condition to said non-securing condition, and wherein said movable member comprises means for moving said movable member from said non-interfering position to said interfering position when said securing means is moved from its securing condition to its non-securing condition.

8. A ski binding according to claim 1 wherein said securing means comprises:

a clamping means having an open condition and a closed condition for releasably securing a ski boot to a ski rearward of the toe and forward of the rear of the heel of the ski boot;

a force unit for providing a clamping force for said clamping means;

means for coupling said force unit to said clamping means;

means for moving said clamping means from said closed condition to said open condition;

a holding means;

means for releasably engaging said holding means and said coupling means when said clamping means is moved to said open condition for holding said clamping means in said open condition against said clamping force; and said changing means comprises means for releasing said coupling means from said holding means.

9. A ski binding according to claim 8 wherein said coupling means comprises a holding means receiving slot; said holding means comprises a slot engaging means for engaging said slot; said engaging means comprises a spring member; and said changing means comprises a solenoid assembly operable in conjunction with said holding means for disengaging said slot engaging means from said slot against the force of said spring member.

10. An electrical releasable step-in ski binding comprising:

securing means movable from a non-securing condition to a securing condition for releasably securing a ski boot to a ski;

a force unit for applying a securing force to the securing means;

means for holding the securing means in the non-securing condition against the securing force; and electrical means responsive to placing of the ski boot in skiing position relative to the securing means for releasing the securing means from the holding means.

11. A ski binding according to claim 10 wherein the electrical means includes a pair of electrical contacts and means for electrically coupling the contacts in response to placing the ski boot in skiing position relative to the securing means.

12. A ski binding according to claim 10 wherein the electrical means includes means responsive to the coupling of the contacts for coupling a source of electrical power to the electrical means and for decoupling the source of power from the electrical means after the securing means is changed from the non-securing condition to the securing condition.

13. A ski binding according to claim 10 wherein the holding means includes a movable member having an interfering position for preventing movement of the securing means and a non-interfering position for allowing movement of the securing means, and wherein the releasing means includes means for moving the movable member from the interfering position to the non-interfering position.

14. A ski binding according to claim 13 wherein the moving means includes a solenoid assembly operable in response to placing the ski boot in skiing position relative to the securing means for moving the movable member from the interfering position to the non-interfering position.

15. A ski binding according to claim 13 wherein the securing means includes means for moving the securing means from the securing condition to the non-securing condition, and wherein the movable member includes means for moving the movable member from the non-interfering position to the interfering position when the securing means is moved from its securing condition to its non-securing condition.

16. A ski binding according to claim 10 wherein the securing means comprises:

a clamping means having an open condition and a closed condition for releasably securing a ski boot to a ski rearward of the toe and forward of the rear of the heel of the ski boot;

a force unit for providing a clamping force for the clamping means;

means for coupling the force unit to the clamping means;

means for moving the clamping means from the closed condition to the open condition;

means for releasably engaging the holding means and the coupling means when the clamping means is moved to the open condition for holding the clamping means in the open condition against the clamping force; and wherein the electrical means includes means for releasing the coupling means from the holding means.

17. A ski binding according to claim 16 wherein the coupling means includes a holding means receiving slot; the holding means includes a slot engaging means for engaging the slot; the engaging means includes a spring member; and the changing means includes a solenoid assembly operable in conjunction with the holding means for disengaging the slot engaging means from the slot against the force of the spring member.

18. A ski binding according to claim 17 wherein the solenoid assembly includes electrical contacts for coupling power to the solenoid assembly when the contacts are electrically coupled and the binding includes means for coupling the electrical contacts in response to the placing of the ski boot in skiing position.

19. A ski binding according to claim 18 wherein the solenoid assembly comprises means for decoupling power from the solenoid assembly when the clamping means is moved to its closed condition.

20. An electrical releasable step-in ski binding comprising:

a clamping means having an open condition and a closed condition for releasably securing a ski boot to a ski rearward of the toe and forward of the rear of the heel of the ski boot;

a force unit for providing a clamping force for the clamping means;

means for coupling the force unit to the clamping means;

means for moving the clamping means from the closed condition to the open condition;

holding means;

means for releasably engaging the holding means and the coupling means when the clamping means is moved to the open condition for holding the clamping means in the open condition against the clamping force; and electrical means responsive to placing the ski boot in skiing position relative to the securing means for releasing the coupling means from the holding means to enable movement of the securing means from the non-securing condition to the securing condition.

21. A ski binding according to claim 20 wherein the coupling means includes a holding means receiving slot; the holding means includes a slot engaging means for engaging the slot; the engaging means includes a spring member; and the changing means includes a solenoid assembly operable in conjunction with the holding means for disengaging the slot engaging means from the slot against the force of the spring member.

22. A ski binding according to claim 21 wherein the solenoid assembly includes electrical contacts for coupling power to the solenoid assembly when the contacts are electrically coupled and the binding includes means for coupling the electrical contacts in response to the placing of the ski boot in skiing position.

23. A ski binding according to claim 22 wherein the solenoid assembly includes means for decoupling power from the solenoid assembly when the clamping means is moved to its closed condition.

* * * * *